US005867832A

United States Patent [19]

Liu

[11] Patent Number: 5,867,832

[45] Date of Patent: Feb. 9, 1999

[54] DISPOSABLE VINYL GLOVE HAVING FASTENING BELT

[76] Inventor: Fang Yi Liu, 2498 Robert Rd., Rowland Heights, Calif. 91748

[21] Appl. No.: 986,759

[22] Filed: Dec. 8, 1997

[51] Int. Cl.[6] ..... A41D 19/00

[52] U.S. Cl. ..... 2/161.7; 2/162; 2/168

[58] Field of Search ..... 2/161.7, 162, 168, 2/16, 159, 158, 160, 161.1, 161.6

[56] References Cited

U.S. PATENT DOCUMENTS

| | | | |
|---|---|---|---|
| 374,676 | 12/1887 | Helfaer | 2/168 |
| 1,979,130 | 10/1934 | Wiley | 2/168 |
| 2,518,424 | 8/1950 | Kaas | 2/163 |
| 3,381,989 | 5/1968 | Thomas | 2/162 |
| 3,476,108 | 11/1969 | Matukas | 2/16 |
| 4,471,495 | 9/1984 | Kruse et al. | 2/162 |
| 4,845,780 | 7/1989 | Reimers et al. | 2/161.7 |
| 4,884,300 | 12/1989 | Vistins | 2/162 |
| 5,020,159 | 6/1991 | Hellickson | 2/161.7 |
| 5,442,816 | 8/1995 | Seketa | 2/161.7 |
| 5,467,483 | 11/1995 | Saadatmanesh et al. | 2/161.7 |

*Primary Examiner*—Amy B. Vanatta

[57] ABSTRACT

A disposable vinyl glove having a fastening belt includes a hollow formed seamless body member, an open proximal end, and a cuff portion at the proximal end. The cuff portion has a fastening belt fixed on the outside surface of the cuff portion. The end of the fastening belt has an adhesive area, an adhesive layer is covering the adhesive area and a removable release sheet is covering the adhesive layer. The adhesive layer can stick with the surface of the cuff or tying belt together. After the glove is worn, the cuff of the glove is tightened on the wearer's wrist by the fastening belt and the adhesive means sticks the fastened tying belt and the outer surface of the cuff together, thereby the disposable vinyl glove is tightly secured on the wearer's hand. Thus, the disadvantages of the glove being loose on the wearer's hand and the chance that liquid can move into the glove are avoided. The improved disposable vinyl gloves are a kind of the best alternative gloves to disposable latex gloves which may affect a certain percentage of the population with an allergic reaction.

2 Claims, 3 Drawing Sheets

DISPOSABLE VINYL GLOVE HAVING FASTENING BELT

BACKGROUND OF THE INVENTION

The present invention relates to vinyl gloves and more particularly concern disposable vinyl gloves used in medicine, laboratory and industry fields where gloves are used to prevent infection, disease and injury from harmful materials.

Disposable gloves are widely used in the above listed industries to protect the user's hands and to avoid the contact with bacterium, viruses and harmful materials. Gloves have become mandatory in many industries and in all medical environments where there is the potential for the exchange of bodily fluids.

Disposable gloves manufactured with latex have the highest usage rate in the United States. Part of this is due to the fact that the glove fits tightly and feels like a "second skin". However, in recent years there has been a great deal of problems concerning latex, due to allergic reactions to latex. Because latex is produced by natural rubber trees and then processed to make products such as gloves, latex contains proteins which may contain allergens which affect a certain percentage of the population. In recent years, allergies to latex have become an increasingly more frequent problem.

Due to the latex allergy problems, which can result in life-threatening symptoms, many health care professional and other glove users are choosing alternative gloves for protection. The primary substitution has been vinyl deposable gloves, which are about the same cost and have no harmful proteins. They are latex free and synthetic.

Gloves manufactured with PVC/vinyl materials are increasing in usage. The disadvantage however of the vinyl gloves in that they have less elasticity than the popular latex gloves. The primary problem is that the wrist area does not fit snug and therefore allows for the possible entrance of fluids during usage. This happens because the wrist opening must be as large as the palm to allow donning. This potential problem leads potential users of this glove to be cautious in its usage. Therefore, we have invented the disposable vinyl glove-fastening device.

U.S. Pat. No. 4,884,300 Glove Having Improved Cuff Securing Feature provides a kind of disposable glove. An adhesive means is attached to the inside of the cuff of the glove. After the glove is put on the hand, remove the release sheet from adhesive, press the adhesive against another portion of the cuff so that the glove is secured on the hand of the wearer. However, this kind securing means cannot tighten the cuff on the wrist. Therefore, it does not solve the potential for liquid entering into the inside of the glove.

U.S. Pat. No. 4,845,780 Glove Having Improved Cuff Securing Feature provides a kind of disposable glove. An adhesive means is attached to the inside of the cuff of the glove. Said adhesive means is an adhesive tab projected from the inside of the cuff. After the glove is put on the wearer's hand, remove the release sheet from the adhesive tap, then tighten the cuff on the wrist and press the adhesive tap on the surface of the glove. This kind of securing means can only keep the glove on the wearer's hand, the potential for liquid entering the inside of the glove still cannot be solved.

SUMMARY OF THE INVENTION

The purpose of present invention is to provide a kind of disposable vinyl glove having fastening belt, it can prevent the glove being loose on the wearer's hand and the liquid moving into the inside of the glove during the wearer's operation.

The other purpose of the present invention is to provide a kind of disposable vinyl glove having fastening belt with the above-mentioned advantages, it further possesses characters of simple structure, easy manufacture and low cost.

The present invention is conceived by the following:

A disposable vinyl glove having a fastening belt includes a hollow formed seamless body member including a closed distal end for containing the wearer's finger, an open proximal end, and a cuff portion at said proximal end, said cuff portion has a fastening belt fixed on the outside surface of said cuff portion; the end of said fastening belt has an adhesive area, an adhesive layer is covered on said adhesive area and a removable release sheet is covered on said adhesive layer. Said adhesive layer can stick with the surface of the cuff or tying belt together; after the glove is worn, said cuff of the glove is tightened on the wearer's wrist by the fastening belt and the adhesive means sticks the fastened tying belt with the out surface of the cuff together, thereby the disposable vinyl glove is tight secured on the wearer's hand, the problems of the glove being loose on the wearer's hand and the chance that liquid can move into the glove can be avoided.

The advantages of the present invention are obvious. As the present invention solves the above-mentioned disadvantages, the main obstacles to wide use of the vinyl gloves are removed. More and more people will switch to use vinyl gloves as people being oversensitive to latex gloves. With a large market for vinyl gloves, the present invention has immense market value.

DETAILED DESCRIPTION

With reference to the drawings, the present invention is given to the following detailed description. As such, those skilled in the art will appreciate that the conception, upon which this disclosure is based, may readily be utilized as a basis for the designing of other structures, methods and system for carrying out the several purposes of the present invention. It is essential, therefor, that the claims be regarded as including such equivalent constructions insofar as they do not depart from the spirit and scope of the present invention.

Figure 1:
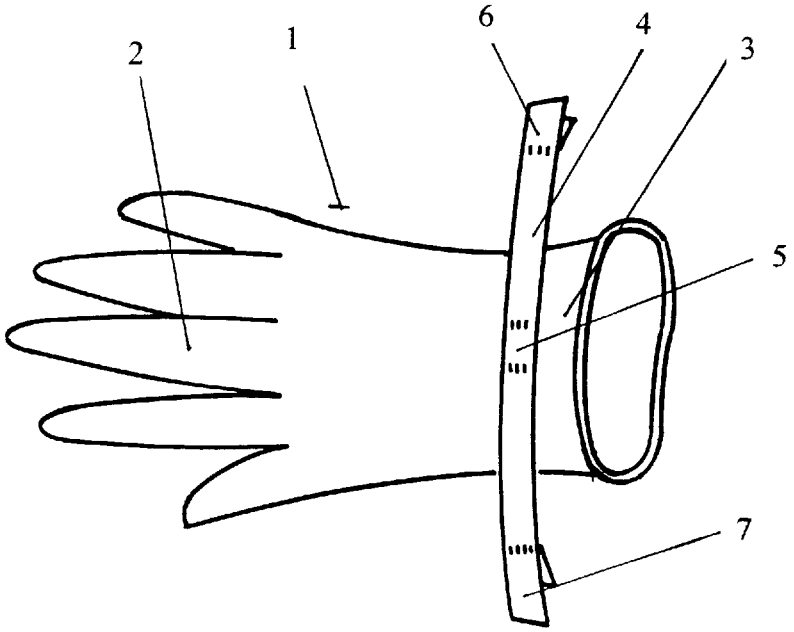
FIG. 1 is a perspective view of the disposable vinyl glove having fastening belt of the present invention.
Figure 2:
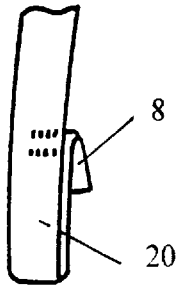
FIG. 2 is a partial perspective view of the end of the fastening belt of the glove illustrated in FIG. 1.

FIG. 1 illustrates a disposable vinyl glove having fastening belt 1 including a hollow formed seamless body member 2 including a closed distal end for containing the wearer's finger, an open proximal end and a cuff portion 3. An elongate fastening belt 4, the middle part of it 4 is fixed on the out surface of the cuff 3 near the open side of the cuff 3 by glue or other common methods. The elongate fastening belt 4 is longer than the circumference of the wearer's wrist. Two ends of the elongate fastening belt 4 have adhering areas 6, 7. FIG. 2 illustrates that the adhering area 6, 7 is covered with an adhesive layer 20 and a removable release sheet 8 is covered on the adhesive layer 20. The removable release sheet 8 can be a sheet of paper or plastic or fabric. After the release sheet 8 is removed, the ends of the elongate fastening belt 4 can be removably adhering to the out surface of the cuff 3 or the fastening belt 4 by the adhesive layer 20.

Figure 5:
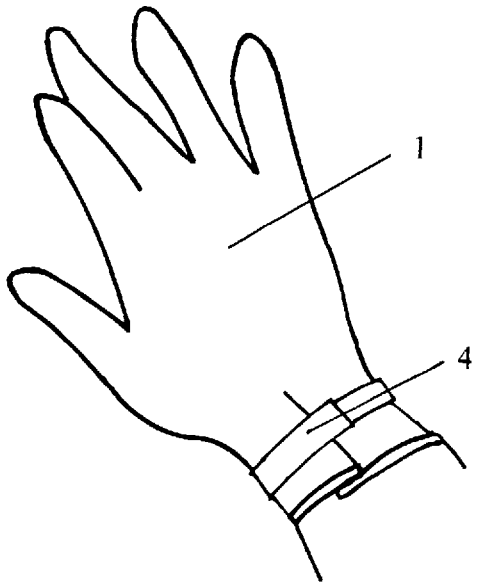
FIG. 5 is a perspective view of the gloves illustrated in FIG. 1 and 4 which are positioned on the wearer's hand and the fastening belts are fastened.

As illustrated in FIG. 5, the glove 1 shown in FIG. 1 is position on the wearer's hand. Remove the release sheet 8, then tighten the cuff 3 on the wearer's wrist by the fastening belt 4, then adhere the ends of the fastening belt 4 on the cuff 3 or fastening belt 4. So far, the glove 1 is secured on the wearer's hand without worrying that the glove 1 falls from the wearer's hand or the liquid moves down into the inside of the glove 1 during wearer's operation.

Figure 3:
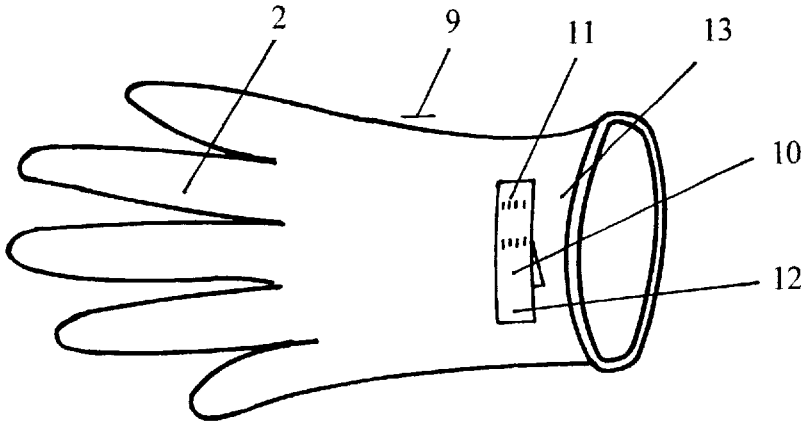
FIG. 3 is a perspective view of another embodiment of the disposable vinyl glove having fastening belt of the present invention.

FIG. 3. illustrates a disposable vinyl glove 9 having fastening belt. The body member and the cuff of the glove 9 are the same as the glove 1. A short fastening belt 10, an end of it 10 is fixed on the out surface of the cuff 3 near the open side of the cuff 3 by glue or other common methods. Another end of the fastening belt 10 has an adhering area 12 having the same structure shown in FIG. 2. The adhering area 12 is covered with an adhesive layer 20 and a removable release sheet 8 is covered on the adhesive layer 20. The removable release sheet 8 can be a sheet of paper or plastic or fabric. After the release sheet 8 is removed, the ends of the fastening belt 10 can be removably adhering to the out surface of the cuff 3 by the adhesive layer 20.

Figure 6:
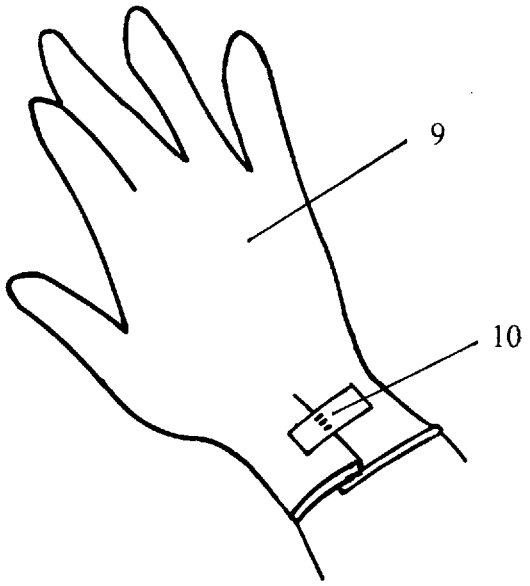
FIG. 6 is a perspective view of the glove illustrated in FIG. 3, which is positioned on the wearer's hand and the fastening belt is fastened.

As illustrated in FIG. 6, the glove 9 shown in FIG. 3 is position on the wearer's hand. Remove the release sheet 8, then tighten the cuff 3 on the wearer's wrist by the fastening belt 10, then adhere the ends of the fastening belt 10 on the cuff 3. So far, the glove 9 is secured on the wearer's hand without worrying that the glove 9 falls from the wearer's hand or the liquid moves down into the inside of the glove 9 during wearer's operation.

Figure 4:
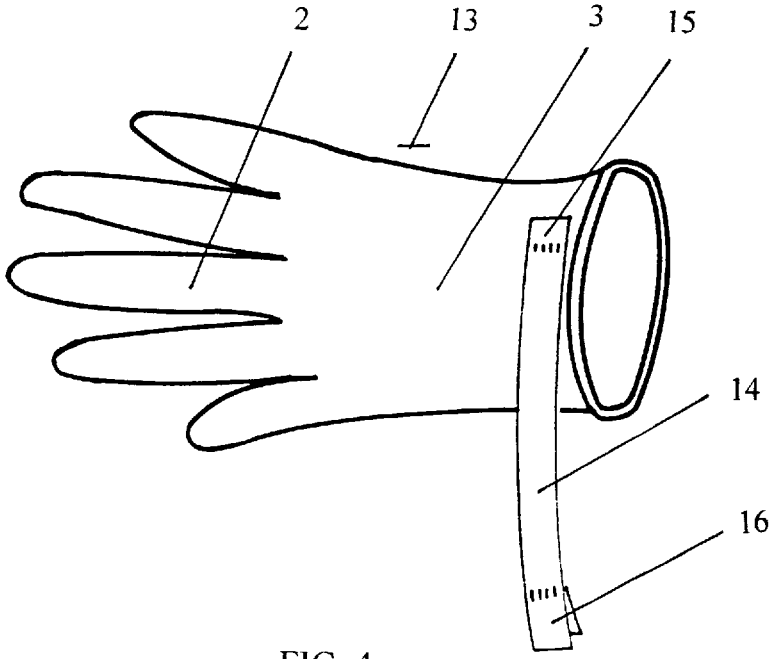
FIG. 4 is a perspective view of another embodiment of the disposable vinyl glove having fastening belt of the present invention.

As illustrated in FIG. 4, a disposable vinyl glove 13 having fastening belt has the same structures of the body member 2, open proximal end and cuff portion 3 as the glove 1. An elongate fastening belt 14, an end of it 14 is fixed on the out surface of the cuff 3 near the open side of the cuff 3 by glue or other common methods. Another end of the fastening belt 14 has an adhering area 16 having same structure shown in FIG. 2. The elongate fastening belt 14 is longer than the circumference of the wearer's wrist. The adhering area 16 is covered with an adhesive layer 20 and a removable release sheet 8 is covered on the adhesive layer 20. The removable release sheet 8 can be a sheet of paper or plastic or fabric. After the release sheet 8 is removed, the ends of the fastening belt 14 can be removably adhering to the out surface of the cuff 3 or the belt 14 by the adhesive layer 20.

FIG. 5 illustrates the usage of gloves 1, 13. The glove 1 or 13 is positioned on the wearer's hand. Remove the release sheet 8, then tighten the cuff 3 on the wearer's wrist by the fastening belt 4 or 14, then adhere the ends of the fastening belt 4 or 14 on the cuff 3. So far, the glove 1 or 13 is secured on the wearer's hand without worrying that the glove 1 or 13 is loose on the wearer's hand or the liquid moves down into the inside of the glove 1 or 9 or 13 during wearer's operation.

The Way of taking off gloves 1, 9, 13 are the same. Separating the fastening belt from the cuff or fastening belt by tearing it, the cuff is opened, then the glove 1, 9, 13 can be pulled off easily.

What is claimed is:

1. A disposable vinyl glove comprising:

a hollow formed seamless body member including a closed distal end for containing a wearer's fingers and a cuff portion at a proximal end;

a means for preventing liquid from moving into the inside of the glove, said means including:

a fastening belt, said belt being longer than the circumference of the wearer's wrist and being fixed on an outer surface of said cuff portion at a middle portion of said fastening belt;

each end of said fastening belt having an adhering area, an adhesive layer covering said adhering area, and a removable release sheet covering said adhesive layer.

2. A disposable vinyl glove comprising:

a hollow formed seamless body member including a closed distal end for containing a wearer's fingers and a cuff portion at a proximal end;

a means for preventing liquid from moving into the inside of the glove, said means including a fastening belt, said belt being longer than the circumference of the wearer's wrist and having two ends, said belt being fixed on an outer surface of said cuff portion at one end of said fastening belt, the other end of said fastening belt having an adhering area, an adhesive layer covering said adhering area, and a removable release sheet covering said adhesive layer.

* * * * *